US009866958B2

(12) United States Patent
Macours

(10) Patent No.: US 9,866,958 B2
(45) Date of Patent: Jan. 9, 2018

(54) ACCOUSTIC PROCESSOR FOR A MOBILE DEVICE

(71) Applicant: NXP B.V., Eindhoven (NL)

(72) Inventor: Christophe Marc Macours, Hodelge (BE)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 15/333,897

(22) Filed: Oct. 25, 2016

(65) Prior Publication Data

US 2017/0118556 A1 Apr. 27, 2017

(30) Foreign Application Priority Data

Oct. 26, 2015 (EP) ..... 15191381

(51) Int. Cl.
*H04R 3/00* (2006.01)

(52) U.S. Cl.
CPC ..... *H04R 3/005* (2013.01); *H04R 2400/01* (2013.01); *H04R 2430/21* (2013.01); *H04R 2499/11* (2013.01)

(58) Field of Classification Search
CPC H04R 3/005; H04R 2400/01; H04R 2430/21; H04R 2499/11
USPC ..... 381/91–92
See application file for complete search history.

(56) References Cited

U.S. PATENT DOCUMENTS 6,473,733 B1 * 10/2002 McArthur ..... G10L 21/0208 704/200.1
8,509,459 B1 * 8/2013 Isvan ..... H04R 3/06 381/111
8,750,528 B2 * 6/2014 Dong ..... H04R 3/00 381/123
2005/0136848 A1 6/2005 Murray
2008/0021703 A1 * 1/2008 Kawamura ..... H04R 3/005 704/226
2013/0156221 A1 * 6/2013 Matsuo ..... H04B 15/00 381/92
2013/0279730 A1 * 10/2013 Tanaka ..... H04R 1/021 381/333

(Continued)

OTHER PUBLICATIONS van Waterschoot, Toon et al; "Acoustic zooming by multi-microphone sound scene Manipulation"; J. Audio Eng. Soc., vol. 61, No. 7/8; pp. 489-507 (Jul./Aug 2013).

(Continued)

*Primary Examiner* — Disler Paul

(57) ABSTRACT

An acoustic processor for a mobile device is described the mobile device comprising a speaker including a speaker membrane, the speaker membrane having a first speaker membrane side and second speaker membrane side opposite the first speaker membrane side, a mobile device housing for providing a first acoustic path between the first speaker membrane side and the exterior of the mobile device and a second acoustic path between the second speaker membrane side and the exterior of the mobile device, the acoustic processor being configured and arranged to sense a signal on an acoustic processor input, the signal being induced on at least one terminal of the speaker in response to acoustic waves process the induced signal to discriminate between acoustic waves from different directions; and output the processed signal on an acoustic processor output.

14 Claims, 5 Drawing Sheets

(56) References Cited

U.S. PATENT DOCUMENTS

| | | | | |
|---|---|---|---|---|
| 2014/0270312 | A1 | 9/2014 | Melanson et al. | |
| 2016/0094910 | A1 * | 3/2016 | Vallabhan | H04R 3/005 381/92 |

OTHER PUBLICATIONS

Extended European Search Report for Application No. 15191381.1; 6 pages; (dated Feb. 12, 2016).

* cited by examiner

300

400

600

ACCOUSTIC PROCESSOR FOR A MOBILE DEVICE

CROSS-REFERENCE TO RELATED APPLICATIONS

This application claims the priority under 35 U.S.C. §119 OF European patent application no 1519138.1, filed Oct. 26, 2016 the contents of which are incorporated by reference herein. This disclosure relates to an acoustic processor for a mobile device and a method of acoustic processing for a mobile device.

Directional sound capture is used in many applications, ranging from studio music recording to audio-visual recording in both professional and consumer cameras. Directional sound capture uses directional microphones or microphone arrays combined with sophisticated array processing algorithms to obtain the desired spatial responses.

Small form factor consumer devices, such as mobile phones or wearables are usually equipped with multiple microphones (typically 2 or more) primarily used for beamforming and non-stationary noise suppression in handset and hands-free voice call applications. Recent applications such as camcording also make use of multiple microphones for stereo or multichannel sound recording.

In flat form factor devices such as smartphones, microphones are usually mounted on the edges of the device. In single-microphone devices, the microphone is placed at the bottom, usually either front-facing or bottom-facing. In dual-microphone devices, one microphone is located at the top, usually either back-facing or top-facing.

Various aspects of the invention are defined in the accompanying claims. In a first aspect there is defined an acoustic processor for a mobile device, the mobile device comprising a speaker including a speaker membrane, the speaker membrane having a first speaker membrane side and second speaker membrane side opposite the first speaker membrane side, a mobile device housing for providing a first acoustic path between the first speaker membrane side and the exterior of the mobile device and a second acoustic path between the second speaker membrane side and the exterior of the mobile device; the acoustic processor being configured and arranged to: sense a signal on an acoustic processor input, the signal being induced on at least one terminal of the speaker in response to acoustic waves ; process the induced signal to discriminate between acoustic waves from different directions; and output the processed signal on an acoustic processor output.

The acoustic processor may receive a signal from a speaker used as a microphone and process the signal to allow front to back discrimination i.e. discriminate between and acoustic source located in front of the mobile device and a further acoustic source located behind the mobile device. This may be used for example in camcorder modes of mobile phones to capture a subject's speech and supress speech from a user of the mobile phone.

In embodiments the acoustic processor may be further configured to mix the induced signal with a further signal sensed via a microphone in response to the at least one acoustic source.

The acoustic processor may include a mixer to combine the induced signal from the speaker as microphone with a microphone signal. The resulting processed signal from the acoustic process may comprise the mixed signal and further signal in varying proportions. The mixer may apply filtering and beamforming to the input signals. The response of the induced signal may be equalized to for example align the response of the speaker with an omnidirectional microphone. This aligned response may allow beam forming using the signals from the microphone and the speaker to provide directional selectivity.

In embodiments the acoustic processor may be further configured to determine a signal to noise ratio from at least one of the induced signal and the further signal and to alter the mixing ratio between the induced signal and the further signal dependent on the signal to noise ratio.

In embodiments, the acoustic processor may be further configured to process the induced signal to discriminate between an acoustic signal received from an acoustic source in a first direction and a further acoustic signal received from a further acoustic source in a second direction.

In embodiments the acoustic processor may be further configured to process the induced signal to discriminate between an acoustic source located in a first direction with respect to the mobile device and a further acoustic source located in a second direction with respect to the mobile device.

In embodiments a mobile device may include the acoustic processor, the mobile device may comprise a speaker including a speaker membrane, the speaker membrane having a first speaker membrane side and second speaker membrane side opposite the first speaker membrane side, and a mobile device housing for providing a first acoustic path between the first speaker membrane side and the exterior of the mobile device, and a second acoustic path between the second speaker membrane side and the exterior of the mobile device and wherein the mobile device is operable to configure the speaker as a microphone and the acoustic processor input is coupled to the at least one speaker terminal.

Each side of the speaker membrane, that is to say each of the major surfaces may be acoustically coupled to the exterior of the mobile device. The speaker may have a directional response characteristic.

In some examples of mobile devices, all microphones may be located in the same plane and only allow a spatial discrimination along the sides of the phone, that is to say top-to-bottom, left-to-right. Form factor constraints may make it difficult to mount two microphones in an end-fire configuration along the front-back axis so as to allow front-back directivity control. In some examples of mobile devices, a third microphone may be placed near the receiver speaker and sharing the same acoustical port. The third microphone may be used for active noise cancellation in handset mode or as additional microphone in camcording mode so as to obtain an improved front-back discrimination due to the acoustical shadowing of the device for sources located at the back of the device.

In embodiments the mobile device may comprise a camera and be configurable in a camcorder mode of operation, and the acoustic processor may be further configured to store the processed signal.

In embodiments of the mobile device comprising a camera, the mobile device may be configurable in a video call mode, and further configured to transmit the processed signal to a receiver of a video call.

In embodiments, a mobile device including the acoustic processor may be configured as one of a mobile phone, a wearable device, a portable audio player, a personal digital assistant, a laptop, a tablet computer.

In a second aspect, there is defined a method of acoustic processing for a mobile device, the mobile device comprising a speaker including a speaker membrane, the speaker membrane having a first speaker membrane side and second speaker membrane side opposite the first speaker membrane side, a mobile device housing for acoustically coupling each speaker membrane side to the exterior of the mobile device, the method comprising: sensing a signal induced on at least one terminal of the speaker in response to acoustic waves, and processing the induced signal; to discriminate between acoustic waves from different directions; and outputting a processed signal.

In embodiments, the method may further comprise sensing a further signal via a microphone, and combining the induced signal and the further signal.

In embodiments, the method may further comprise estimating the signal to noise ratio from the further signal.

Estimating the signal to noise ratio may be used to determine a measure of the ambient noise.

In embodiments, the method may further comprise estimating the signal to noise ratio value from the induced signal.

In embodiments of the method processing the induced signal may comprise at least one of attenuating the induced signal for a signal to noise ratio value above a predetermined threshold and attenuating the further signal for a signal to noise ratio value below the predetermined threshold.

In a further aspect there is described the use of the speaker as a directional microphone in a mobile device comprising a speaker including a speaker membrane, the speaker membrane having a first speaker membrane side and second speaker membrane side opposite the first speaker membrane side, a mobile device housing for providing a first acoustic path between the first speaker membrane side and the exterior of the mobile device and a second acoustic path between the second speaker membrane side and the exterior of the mobile device.

Embodiments may include an article of manufacture including at least one non-transitory, tangible machine readable storage medium containing executable machine instructions for execution by a processor, wherein the article includes a speaker including a speaker membrane, the speaker membrane having a first speaker membrane side and second speaker membrane side opposite the first speaker membrane side, a housing for acoustically coupling each speaker membrane side to the exterior of the article; and wherein the instructions include sensing a signal induced on at least one terminal of the speaker configured as a microphone in response to at least one acoustic source, and processing the induced signal; wherein at least one characteristic of the processed signal is dependent on the orientation of the mobile device with respect to the at least one acoustic source.

There may be provided a computer program, which when run on a computer, causes the computer to configure any apparatus, including a circuit, controller, sensor, filter, or device disclosed herein or perform any method disclosed herein. The computer program may be a software implementation, and the computer may be considered as any appropriate hardware, including a digital signal processor, a microcontroller, and an implementation in read only memory (ROM), erasable programmable read only memory (EPROM) or electronically erasable programmable read only memory (EEPROM), as non-limiting examples. The software implementation may be an assembly program.

The computer program may be provided on a computer readable medium, which may be a physical computer readable medium, such as a disc or a memory device, or may be embodied as a transient signal. Such a transient signal may be a network download, including an internet download.

BRIEF DESCRIPTION OF DRAWINGS

In the figures and description like reference numerals refer to like features. Embodiments of the invention are now described in detail, by way of example only, illustrated by the accompanying drawings in which.

DETAILED DESCRIPTION

Figure 1A:
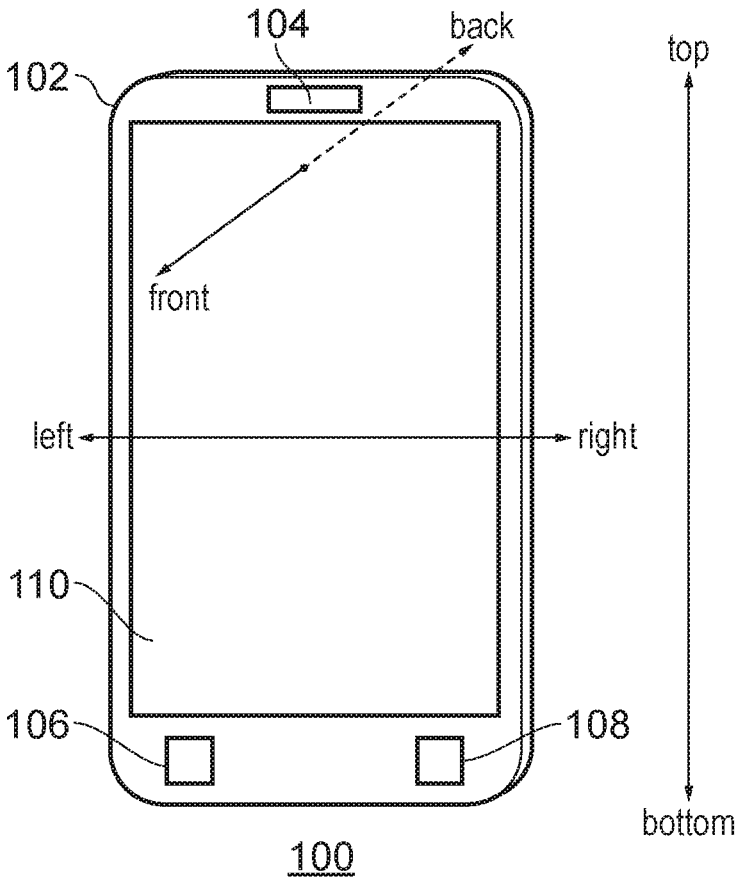
FIG. 1*a* shows an exterior view of a mobile phone including directional sound capture according to an embodiment and FIG. 1*b* shows the mobile smart phone including a speaker and an acoustic processor according to an embodiment.
Figure 1B:
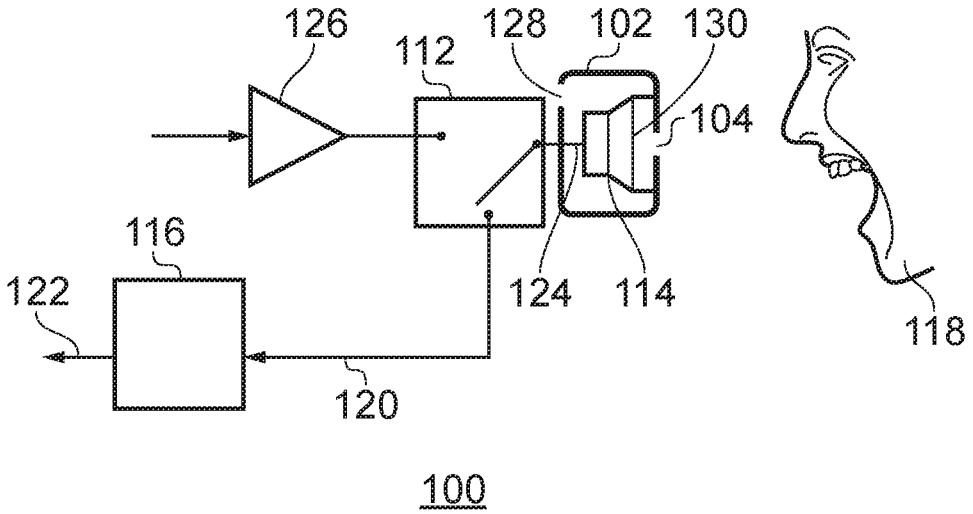

FIG. 1 shows in FIG. 1A a mobile phone 100 showing the housing and location of speaker aperture. FIG. 1B shows the mobile phone 100 including a speaker 114 and an acoustic processor 116. Firstly referring to FIG. 1A, mobile phone 100 may have a housing 102 and an aperture 104 in one of the major surfaces of the housing which may be referred to as the front of the mobile phone. The mobile phone 100 may also have operating buttons 106 and 108 located towards one of the edges of the housing 102. The surface of the mobile phone 100 may include a touch sensitive display 110. The mobile phone 100 may also have one or more microphones (not shown). Now referring to FIG. 1B, a speaker 114 including a speaker membrane 130 or diaphragm. The speaker membrane 130 may have a first side or surface which may face towards the aperture 104 so may be considered for example front facing. The speaker membrane 130 may have a second side or surface facing away from the aperture 104 which may for example be considered back facing. The speaker 130 may emit the acoustic signal, typically an audible signal which may for example contain speech and/or music via a first acoustic path through the aperture 104. The aperture 104 may therefore acoustically couple the first side of the speaker membrane to the exterior of the mobile phone 100.

The speaker 114 may be a receiver speaker for use in a handset voice call mode of operation whereby the receiver speaker is closely coupled to the ear of a user. This is typically referred to as a near field mode of operation. The housing 102 may have a further aperture 128 which may provide a further acoustic path from the exterior of the mobile device 100 to the second side of the speaker membrane via the back of the speaker 114. The skilled person will appreciate that there may be an acoustic path through the back of the speaker to the second side of the speaker membrane 130 via the aperture 128. Consequently the further aperture 128 in the housing 102 may provide an acoustic coupling between the second side of the speaker membrane 130 and the exterior of the mobile phone 100.

The speaker 114 may be driven by an amplifier 126 which may be connected to the speaker via a switch 112. The switch 112 may be controlled by a controller (not shown) and connect the amplifier 126 to the speaker 114. The switch 112 may connect an acoustic processor input 120 of the acoustic processor 116 to the speaker 114.

The skilled person will appreciate that the switch 112 may be implemented in hardware using MOS transistors. The switch 112 may be controlled by a controller implemented in hardware or a combination of hardware and software. The switch 112 may be implemented by any hardware or software which allows a signal to be either driven from the amplifier 126 to the speaker 114 or routed from the speaker terminal or terminals 124 to the acoustic processor input 120.

The acoustic processor 116 may be implemented in hardware/software or a combination of hardware and software. The acoustic processor 116 may be implemented for example using software running on a digital signal processor. The acoustic processor 116 may apply filters, and/or equalization to an acoustic signal received on the acoustic processor input 120. The acoustic processor 116 may apply threshold value to the acoustic signal that is to say compare the acoustic signal with an expected minimum level. It will be appreciated that the acoustic processor 116, the amplifier 110 which may be a class D audio amplifier and the switch 112 are illustrated as being outside the housing 102 but will be contained within the housing 102 of the mobile device.

In operation of the mobile phone 100, in a first mode which may for example be a mode whereby a user is making a voice call, the amplifier 110 may be connected to the loudspeaker 114 via the switch 112. The speaker 114 is then used in its intended operation mode as a receiver speaker in a so-called near field mode of operation whereby speech received from a third-party may be heard by the user of the mobile phone 100. The speaker 114 is typically closely coupled to the ear of a user 118 in this mode and so is typically at a distance of less than 1 cm from the ear of a user 118. In a second mode of operation, the acoustic processor input 120 may be connected to one or more speaker terminals 124 via the switch 112. The speech of user 118 of the mobile phone 100 may induce a signal on the terminal 124 of the speaker 114. The speech signal may be processed by the acoustic processor 116 and the processed speech signal may be output on the acoustic processor output 122.

The inventor has realised that the response of the speaker used in this way may be direction dependent and so may be processed to, for example, discriminate between acoustic sources dependent on their location with respect to the front or back of the mobile phone 100, since the processed signal characteristics such as amplitude, frequency, gain may vary dependent on the orientation of the mobile phone 100 with respect to a particular acoustic source. The processed signal may improve the quality of the speech signal or other desired source with respect to background acoustic sources which may be considered as noise sources.

Figure 2:
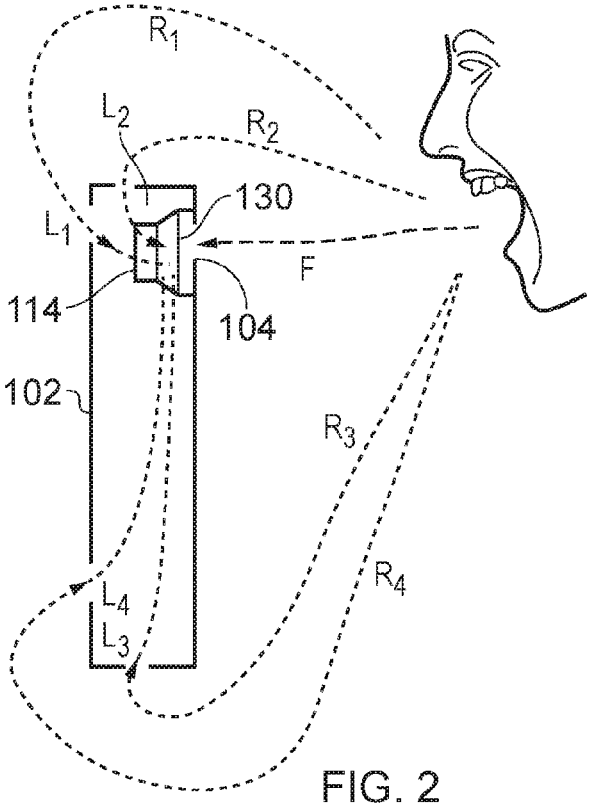
FIG. 2 illustrates the acoustic coupling between the speaker membrane and the exterior of the mobile phone of FIG. 1.

Referring now to FIG. 2, the speaker 114 may be mounted within the housing in a so-called "open back" configuration whereby the speaker is not enclosed in a separate module but the housing 102 provides the back volume denoted V. The mobile phone housing 102 may have unintentional and uncontrolled acoustic leak apertures, indicated as $L_{1-4}$, which may result in an acoustical shortcut between the front side and the back side of the receiver speaker membrane 130. These acoustic leak apertures may be for example due to gaps in the mobile phone housing 102. Alternatively or in addition these leak apertures may be apertures formed in the housing for other purposes. Alternatively or in addition the mobile phone housing may be at least partially acoustically transparent due to the material and or thickness of areas of the housing.

For a sound source for example from a user speaking in front of the mobile phone 100, the sound pressure wave may reach the front of the receiver speaker membrane 130 through the front port, denoted as acoustic path F, but also the back of the receiver speaker membrane 130 through the multiple leak paths indicated as $R_1$ to $R_4$. This acoustical shortcut may cause the receiver speaker to behave as a gradient pressure transducer, whereby the amplitude of the sound pressure wave picked-up (or transmitted) by the receiver speaker 114 may be a function of the angle of incidence of the sound wave. The rear leak paths R1 to R4 may be undefined and dependent on the mechanical construction of the device. However, the surprising result is that the speaker may have a directional response when configured as a microphone.

The directional response may make it possible to use the receiver speaker of a mobile phone as a directional microphone across the front-back axis and allow front-back sound discrimination, especially in applications where the mobile phone is held vertically such as during a video calling or while video recording or cam-cording.

Figure 3:
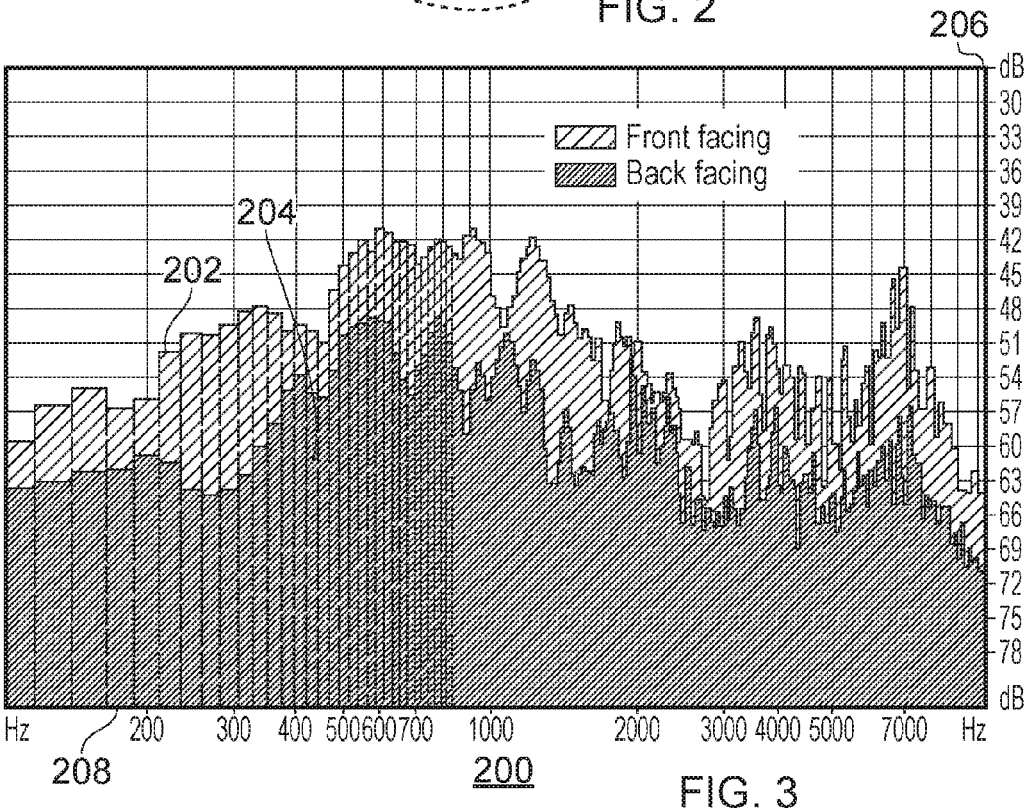
FIG. 3 shows a graph of an example directional response of a speaker configured as a microphone in the embodiment of FIG. 1.

FIG. 3 shows a graph 200 of an example frequency response of a receiver speaker in a mobile phone when configured as a microphone. The x-axis 208 shows the frequency varying between 0 Hz and approximately 10 kHz. The y-axis 206 shows the gain in relative decibels between approximately −100 dB to −30 dB. Frequency response 202 shows the response for the situation where the acoustic sources are located at the front of the mobile phone, that is to say the acoustic waves are travelling from the acoustic sources towards the major surface of the mobile phone containing the speaker aperture 104. The frequency response 204 shows the response for the situation where the acoustic source is behind the mobile phone, that is to say the acoustic waves are travelling from the acoustic sources towards the major surface of the phone which is opposite the surface having the speaker aperture 104. As can be seen, the gain for the front facing response 202 is significantly higher than the gain of the back facing response 204. For example, at a frequency of approximately 7 kHz the gain for the front facing source is approximately −45 dB and the gain for the back-facing source is approximately −57 dB. At a frequency of approximately 1 kHz the gain for the front facing source is approximately −43 dB and the gain for the rear facing source is approximately −55 dB. At a frequency of approximately 300 Hz the gain for the front facing source is approximately −50 dB and the gain for the rear facing source is approximately −64 dB. In general the gain for a front-facing source may be more than 6 dB higher than for a back facing acoustic source. For a use case where the desired acoustic source is located in front of the mobile device and a noise source is located at the back of the mobile device, it will be appreciated that this may improve the signal to noise ratio by more than 6 dB. It will be appreciated that the terms front-facing and back-facing may be considered as relative terms used to refer to opposing major surfaces of the housing of the mobile phone.

Figure 4:
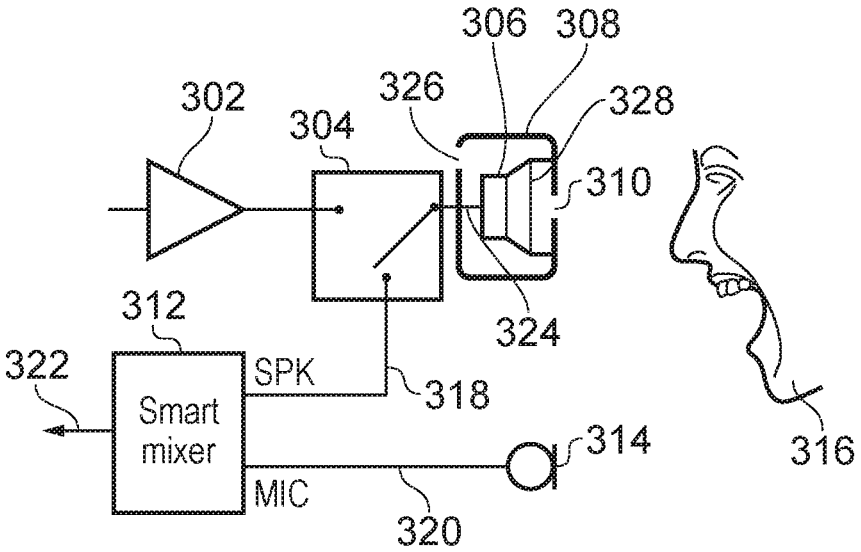
FIG. 4 shows a mobile device including an acoustic processor according to an embodiment.

FIG. 4 shows a mobile device 300. The mobile device 300 may have a housing 308 and an aperture 310 in one of the surfaces of the housing 308 which may be considered as the front of the mobile device 300. The mobile device 300 may have a microphone 314. A speaker 306 may include a speaker membrane or diaphragm 328 and emit the acoustic signal, typically an audible signal which may for example contain speech and/or music through the aperture 310. The speaker membrane 328 may have a first side or surface which may face towards the aperture 312 so may be considered for example front facing. The speaker membrane 328 may have a second side or surface facing away from the aperture 310 so may be considered back facing. The housing 308 may have a further aperture 326 which may provide a further acoustic path from the exterior of the mobile device 300 to the second side of the speaker membrane 328 via the back of the speaker 306. The skilled person will appreciate that there may be an acoustic path through the back of the speaker to the second side of the speaker membrane 328 via the further aperture 326. Consequently the further aperture 326 in the housing 308 may provide an acoustic coupling between the second side of the speaker membrane 328 and the exterior of the mobile device 300.

The speaker 306 may be driven by an amplifier 302 which may be a class D audio amplifier connected to the speaker 306 via a switch 304. The switch 304 may be controlled by a controller (not shown) and connect the amplifier 302 to the speaker 306. The switch 304 may connect a first acoustic processor input 318 of the acoustic processor 312 to the speaker 306. A microphone 314 which may be an omnidirectional microphone may be connected to a second acoustic processor input 320.

The acoustic processor 312 may be implemented in hardware/software or a combination of hardware and software. The acoustic processor 312 may be implemented for example using software for execution on a digital signal processor. The software may be stored in a memory such as RAM, ROM or EPROM or other non-transitory, tangible machine readable storage medium. The acoustic processor 312 may apply filters, and/or equalization to a signal received on the first acoustic processor input 318 and a further signal received on the second acoustic processor input 320. The acoustic processor 312 may apply threshold value to the acoustic signal that is to say compare the acoustic signal with an expected minimum level. It will be appreciated that the acoustic processor 312, the amplifier 302 which may be a class D audio amplifier and the switch 304 are illustrated as being outside the housing 308 but may be contained within the housing 308 of the mobile device 300.

In operation of the mobile device 300, in a first mode the amplifier 302 may be connected to the loudspeaker 306 via the switch 304. The speaker 306 may then be used in its intended operation mode as a speaker for emitting an audio signal or other acoustic signal. In a second mode of operation, the acoustic processor input 312 may be connected to one or more speaker terminals 324 via the switch 304. Speech from a user 316 of the mobile device 300 may induce a signal on the terminals 324 of the speaker 306. The speech signal may be processed by the acoustic processor 312 and the processed speech signal may be output on the acoustic processor output 322. The characteristic of acoustic signals received via the speaker 306 used in this way may be direction dependent and so may be processed to discriminate between speech or other acoustic source dependent on the location of the acoustic source with respect to the front surface of the mobile device 300. A further signal sensed via the microphone 314 may not be direction dependent. The acoustic processor may mix the acoustic signal received from the speaker 306 with the further acoustic signal received from the microphone to reduce the background noise present in the processed signal. The skilled person will appreciate that since the distance between the speaker and a microphone is known, by filtering the received acoustic signal and the further acoustic signal, the processed mixed signal from the output of the acoustic processor may have different polar characteristics than the characteristics of the microphone or speaker in isolation. Filtering or other beam forming techniques may be used to respond selectively to a sound source from a particular direction. Consequently the processed signal may improve the quality of the speech signal or other desired source with respect to background acoustic signals.

Figure 5:
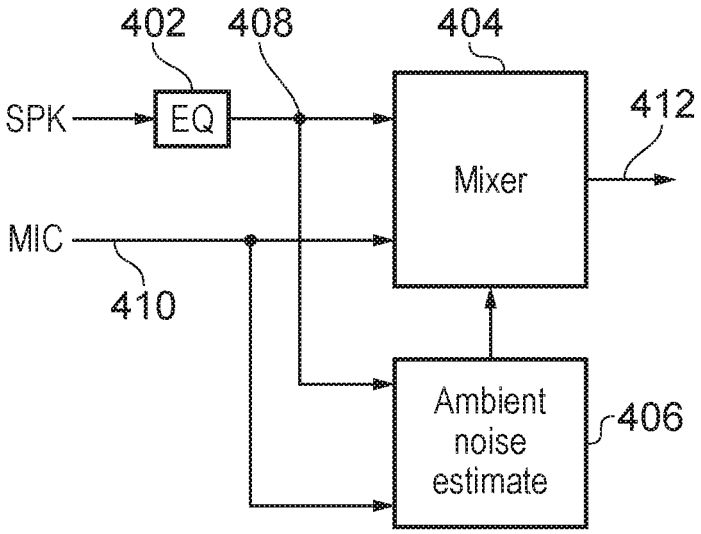
FIG. 5 illustrates an acoustic processor for one or more mobile devices according to an embodiment.

FIG. 5 shows an example of an acoustic processor 400. An equaliser 402 may receive an input signal from a speaker. The output 408 of the equaliser 402 may be connected to an ambient noise estimator 406. The output 408 of equaliser 402 may also be connected to the mixer 404. A microphone input 410 may be connected to the mixer 404 and the ambient noise estimator 406. Equaliser 402 may align the speaker and microphone responses for a sound source. The mixer output 412 may be the output of the acoustic processor 400. The mixer 404 may delay and sum the responses of particular frequencies for the speaker and the microphone such that they interfere constructively or destructively for a specific location. The mixer 404 may apply other beam forming techniques. The skilled person will appreciate that the resulting output of the mixer 404 may shape the polar pattern of the signal from the microphone input 410 and the signal from the equalizer output 408 which corresponds to the signal from the speaker used as a microphone.

In operation the background noise level may be estimated by the ambient noise estimator 406. The ambient noise estimator may determine an estimate of the background noise level from the signal to noise ratio value of the input signals. The ambient noise estimator 406 may use either or both of the signals received via the equaliser output 408 or the microphone input 410. Dependent on the background noise level, the mixing ratio between the equalised speaker signal on equaliser output 408, and the microphone signal received on the microphone input 410, may be modified. For low ambient noise levels, only the microphone signal may be used. A low ambient noise level may be for example a level that corresponds to a signal to noise ratio value of above 20 dB measured in decibels for the unprocessed signal. At a high ambient noise levels, only the speaker may be used. A high ambient noise level may for example be a noise level resulting in a signal to noise ratio value of −20 dB or less measured in decibels for the unprocessed signal. For intermediate ambient noise levels the processed output signal may include a mix of both signals received from the equaliser output 408 and the microphone input 410 may be used. The skilled person will appreciate that the noise estimation and the mixing may be performed in different frequency bands.

Figure 6:
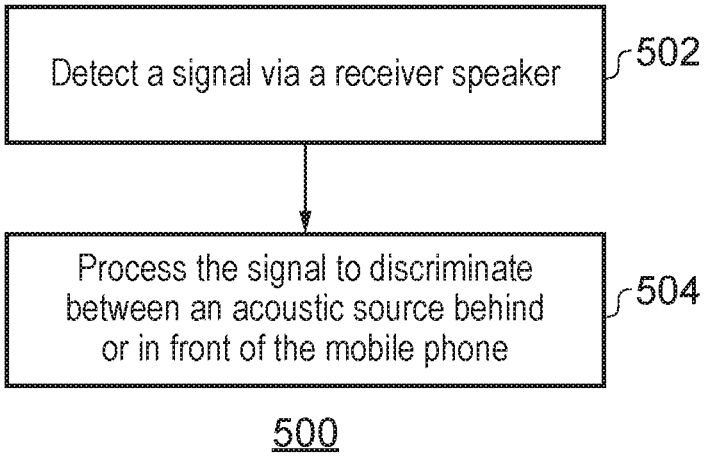
FIG. 6 shows a method of acoustic processing in a mobile device according to an embodiment.

FIG. 6 shows a method of acoustic processing for a mobile phone 500. In step 502 is an acoustic signal may be detected by a receiver speaker. The acoustic signal may include a desired signal generated from an acoustic source such as a person speaking, a music source, or some other acoustic source. The acoustic signal may include an undesired noise signal from other acoustic sources. In step 504, the acoustic signal may be processed to discriminate between a desired acoustic source located at the front of the mobile phone and an undesired acoustic source. The acoustic signal characteristics of the processed signal received via the receiver speaker may vary dependent on whether the acoustic sources are located behind or in front of the mobile phone. These acoustic signal characteristics for example gain may be used to determine whether or not the acoustic source is behind or in front of the phone. Alternatively or in addition, when in a certain operating mode, for example in a mobile phone operating in hands-free mode, the receiver speaker may be configured as a microphone and used to improve the speech capture of a user of the mobile phone.

The method steps 500 may be implemented in hardware, software or a combination of hardware and software. For example, the method may be implemented in software running on a digital signal processor.

Figure 7:
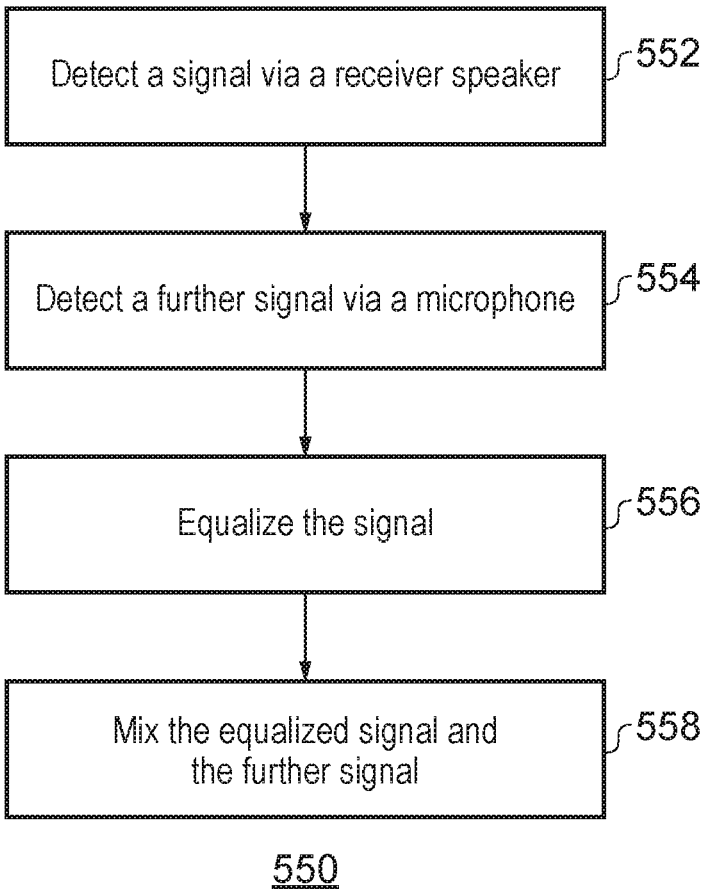
FIG. 7 illustrates a method of acoustic processing in a mobile device according to an embodiment.

FIG. 7 shows a method of acoustic processing for a mobile device 550. In step 552 a signal may be detected by a receiver speaker. In step 554 a further signal may be detected via a microphone. In step 556 the signal may be equalised. Equalisation may align the response of the receiver speaker and the microphone to a source located at the front of a mobile device. The equalization may be an adaptive equalization. The front of the mobile device may be a surface containing the aperture for the receiver speaker. In step 558 the signal and further signal may be mixed. Mixing the signal and the further signal in different proportions may improve the signal-to-noise ratio of the processed output signal dependent on the ambient noise level. By aligning the response of the microphone to that of the speaker, the response of the microphone may be more sensitive to an acoustic source located at the front of the mobile device.

Figure 8:
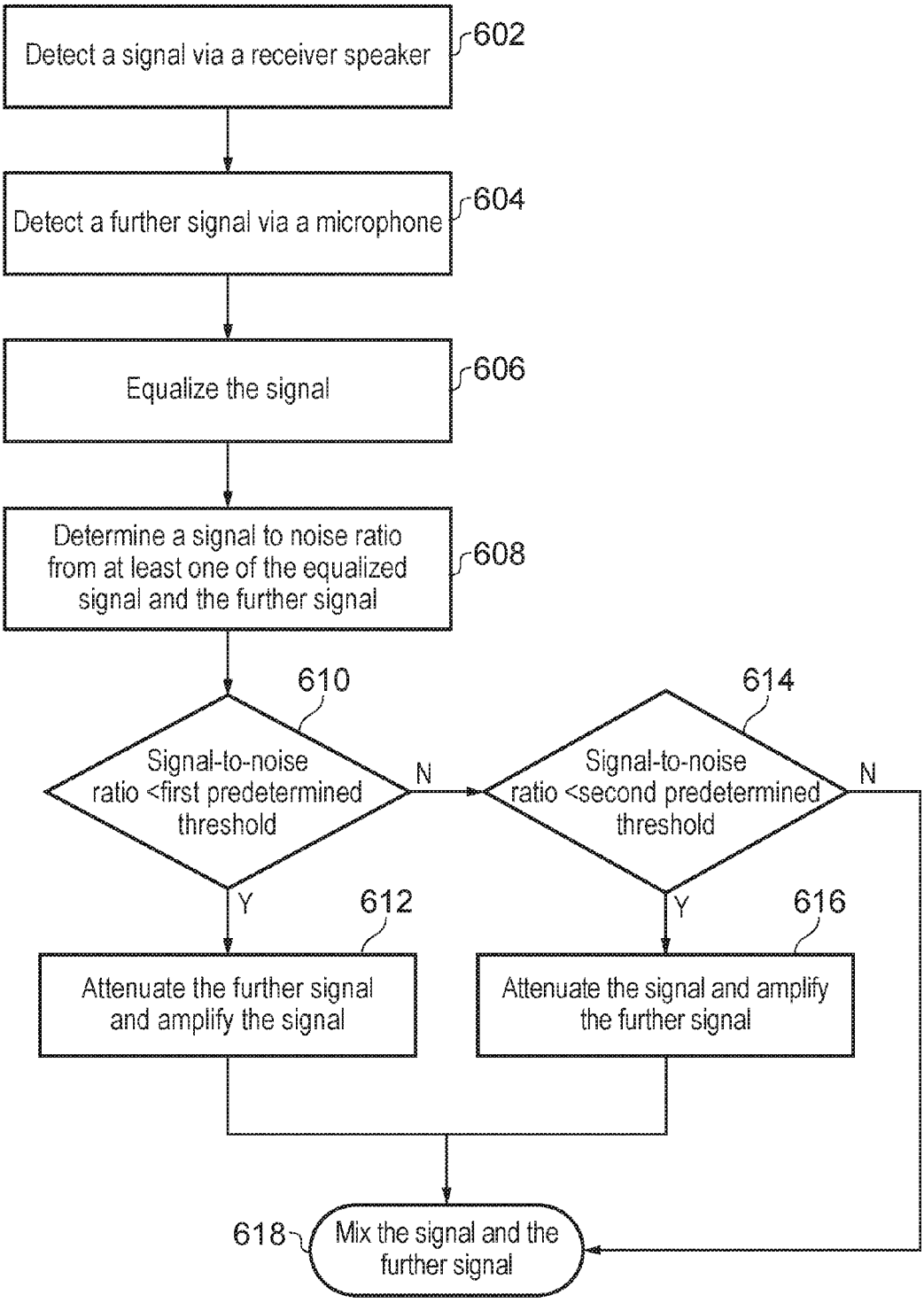
FIG. 8 shows a method of acoustic processing in a mobile device according to an embodiment.

FIG. 8 shows a method of acoustic processing for directional sound capture 600 for a mobile device such as a mobile phone. In step 602 a signal may be detected via a speaker. This signal may be generated from in response to acoustic waves from an acoustic source. In step 604 a further signal may be detected via a microphone which may be an omnidirectional microphone. In step 606 the signal may be equalised. In step 608 a signal to noise ratio may be determined from at least one of the signal and the further signal. In step 610 a comparison may be made to determine whether the signal to noise ratio is less than a first predetermined threshold. If the signal to noise ratio is less than the first predetermined threshold then the method may move to step 612 and the further signal may be attenuated, and the signal may be amplified. The attenuation of the further signal may be at a level at which the further signal is completely supressed. Following step 612, the signal and attenuated further signal may be mixed or combined in step 618 to give the processed output signal. Returning to step 610, if the signal to noise ratio is greater than the first predetermined threshold then the method may move to step 614 where the signal to noise ratio is compared to a second predetermined threshold. In step 614 if the signal to noise ratio is greater than the second predetermined threshold then the method moves to step 616, and the signal may be attenuated and the further signal may be amplified. The attenuation of the signal may be at a level at which the signal is completely supressed. Following step 616, the signal and further signal may be mixed or combined in step 618 to give the processed output signal. Returning to step 614 if the signal to noise ratio is less than the second predetermined threshold the signal and further signal may be mixed or combined in step 618 to give the processed output signal.

At high ambient noise levels the processed signal may be dominated by the signal received via the speaker. At lower ambient noise levels, the processed signal may be dominated by the signal received via the microphone. By varying the contribution of the signal and further signal to the processed signal output, the signal to noise ratio of the processed output signal may be improved.

In embodiments, the mobile devices described herein may include a laptop, mobile phone, a wearable device such as a smart watch, a portable digital assistant, a laptop computer, a tablet computer or any other portable audio device having a speaker with an acoustic path which may be a leak path from the exterior of the mobile device to the back volume of the speaker.

Although the appended claims are directed to particular combinations of features, it should be understood that the scope of the disclosure of the present invention also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable sub combination.

The applicant hereby gives notice that new claims may be formulated to such features and/or combinations of such features during the prosecution of the present application or of any further application derived therefrom.

For the sake of completeness it is also stated that the term "comprising" does not exclude other elements or steps, the term "a" or "an" does not exclude a plurality, a single processor or other unit may fulfil the functions of several means recited in the claims and reference signs in the claims shall not be construed as limiting the scope of the claims.

The invention claimed is:

1. An acoustic processor for a mobile device, the mobile device comprising a speaker including a speaker membrane, the speaker membrane having a first speaker membrane side and second speaker membrane side opposite the first speaker membrane side, a mobile device housing having a first aperture at a front side of the mobile device for providing a first acoustic path between the first speaker membrane side and the exterior of the mobile device and having a second aperture at a back side of the mobile device for providing a second acoustic path between the second speaker membrane side and the exterior of the mobile device;

the acoustic processor being configured and arranged to:

sense a signal on an acoustic processor input, the signal being induced on at least one terminal of the speaker in response to acoustic waves received from an acoustic source that is behind the mobile device and from an acoustic source that is in front of the mobile device;

process the induced signal to discriminate between the acoustic waves received from the acoustic source that is behind the mobile device and from the acoustic source that is in front of the mobile device;

and output the processed signal on an acoustic processor output.

2. The acoustic processor of claim 1 further configured to mix the induced signal with a further signal sensed via a microphone.

3. The acoustic processor of claim 2 wherein the acoustic processor is further configured to equalize the induced signal and to apply beam-forming to the induced signal and the further signal.

4. The acoustic processor of claim 2 further configured to determine a signal to noise ratio from at least one of the induced signal and the further signal and to alter the mixing ratio between the induced signal and the further signal dependent on the signal to noise ratio.

5. The mobile device comprising the acoustic processor of claim 1 and comprising a speaker including a speaker membrane, the speaker membrane having a first speaker membrane side and second speaker membrane side opposite the first speaker membrane side, and a mobile device housing having a first aperture at a front side of the mobile device for providing a first acoustic path between the first speaker membrane side and the exterior of the mobile device, and having a second aperture at a back side of the mobile device for providing a second acoustic path between the second speaker membrane side and the exterior of the mobile device and wherein mobile device is operable to configure the speaker as a microphone and the acoustic processor input is coupled to the at least one speaker terminal.

6. The mobile device of claim 5 comprising a camera wherein the mobile device is configurable in a camcorder mode of operation, and the acoustic processor is further configured to store the processed signal.

7. The mobile device of claim 5 comprising a camera and wherein the mobile device is configurable in a video call mode, and further configured to transmit the processed signal to a receiver of a video call.

8. The mobile device of any of claim 5 configured as one of a mobile phone, a wearable device, a portable audio player, a personal digital assistant, a laptop, a tablet computer.

9. A method of acoustic processing for a mobile device, the mobile device comprising a speaker including a speaker membrane, the speaker membrane having a first speaker membrane side and second speaker membrane side opposite the first speaker membrane side, a mobile device housing having a first aperture at a front side of the mobile device and having a second aperture at a back side of the mobile device for providing for acoustically coupling each speaker membrane side to the exterior of the mobile device, the method comprising:

sensing a signal induced on at least one terminal of the speaker in response to acoustic waves received from an acoustic source that is behind the mobile device and from an acoustic source that is in front of the mobile device, processing the induced signal to discriminate between the acoustic waves received from the acoustic source that is behind the mobile device and from the acoustic source that is in front of the mobile device; and outputting the processed signal.

10. The method of claim 9 comprising sensing a further signal via a microphone, and combining the induced signal and the further signal.

11. The method of claim 10 further comprising estimating the signal to noise ratio from the further signal.

12. The method of claim 10 further comprising estimating the signal to noise ratio value from the induced signal.

13. The method of claim 10 wherein processing the induced signal comprises at least one of attenuating the induced signal for a signal to noise ratio value above a predetermined threshold and attenuating the further signal for a signal to noise ratio value below the predetermined threshold.

14. In a mobile device comprising a speaker including a speaker membrane, the speaker membrane having a first speaker membrane side and second speaker membrane side opposite the first speaker membrane side, a mobile device housing having a first aperture at a front side of the mobile device for providing a first acoustic path between the first speaker membrane side and the exterior of the mobile device and having a second aperture at a back side of the mobile device for providing a second acoustic path between the second speaker membrane side and the exterior of the mobile device, the use of the speaker to function as a directional microphone to discriminate between acoustic waves received from an acoustic source that is behind the mobile device and from an acoustic source that is in front of the mobile device.

* * * * *